United States Patent [19]

Morse et al.

[11] Patent Number: 4,659,420

[45] Date of Patent: Apr. 21, 1987

[54] SHOE SUBSTRATE REINFORCING MACHINE

[75] Inventors: Albert I. Morse, Beverly; John F. Martin, Essex, both of Mass.

[73] Assignee: USM Corporation, Farmington, Conn.

[21] Appl. No.: 851,200

[22] Filed: Apr. 14, 1986

[51] Int. Cl.[4] ..... B65H 9/04

[52] U.S. Cl. ..... 156/556; 118/500; 118/503; 112/121.15; 156/567

[58] Field of Search ..... 118/503, 231, 500; 156/539, 556, 562, 567; 427/284; 112/121.5

[56] References Cited

U.S. PATENT DOCUMENTS

| | | | |
|---|---|---|---|
| 1,250,771 | 12/1917 | Bean | 156/556 |
| 1,569,231 | 1/1926 | Mayo | 112/121.5 |
| 1,987,827 | 1/1935 | Hood | 427/284 |
| 4,480,581 | 11/1984 | Simmonds, Jr. et al. | 118/50 |
| 4,502,411 | 3/1985 | Gilbride et al. | 118/503 |
| 4,503,091 | 3/1985 | Elliott et al. | 118/500 |

FOREIGN PATENT DOCUMENTS

| | | | |
|---|---|---|---|
| 658439 | 10/1951 | United Kingdom | 112/121.5 |

*Primary Examiner*—Sam Silverberg
*Assistant Examiner*—Terry J. Owens
*Attorney, Agent, or Firm*—Spencer T. Smith

[57] ABSTRACT

A machine for depositing powder in a selected configuration, fusing the configured powder into a laminate and adhering the fused laminate to a shoe substrate to reinforce the substrate. The machine has a shoe substrate support including a base and a pad assembly. The base includes a guide plate, guides secured to the guide plate, and detents secured to the guide plate and the pad assembly includes a backing plate having portions to be guided by the guides, stops for a butting against the guides when the backing plate is displaced to its desired location on the guide plate, dimples for cooperating with the detents when the backing plate is located on the backing plate to releasably maintain the backing plate at that location, and a handle. A pad is secured to the backing plate for supporting a shoe substrate and data is secured to its top surface for locating a specific shoe part on the pad.

2 Claims, 2 Drawing Figures

SHOE SUBSTRATE REINFORCING MACHINE

The present invention relates to machines which deposit powder in a selected configuration, fuse the configured powder into a laminate and adhere the fused laminate to a shoe substrate to reinforce the substrate.

In such shoe substrate reinforcing machines, a transfer structure having a plurality of faces (conventionally a cube having four planar faces) is mounted on a spindle and is rotatably indexed from position to position. The top face is the load/unload location where a shoe substrate to be reinforced may be clamped in position on or removed from the transfer cube. The bottom face is the reinforcement position where a fused laminate will be adhered to a shoe substrate by displacing the spindle vertically downwardly to forcefully locate the fused laminate between the bottom face and a machine support plate.

The shoe substrate must be accurately located on the transfer structure prior to clamping so that the fused laminate will be joined to the shoe substrate at the desired location. Conventionally, positioning of the shoe part is controlled by guide pins which are part of an assembly which is lowered into engagement with the transfer structure prior to loading and retracted to a remote location before the transfer structure is operated. Such a guide assembly is disclosed in U.S. Pat. No. 4,502,411.

It is an object of the present invention to secure locational data on the transfer cube to function as the locational guides for defining the correct placement of the shoe substrate.

Other objects and advantages of the present invention will become apparent from the following portion of this specification and from the following drawings which illustrate in accordance with the mandate of the patent statutes, a presently preferred embodiment of the invention.

Referring to the drawings:

FIG. 1 is a top oblique view of a portion of the work transfer cube of a shoe substrate reinforcing machine which deposits powder in a selected configuration, fuses the configured powder into a laminate and adheres the fused laminate to a shoe substrate to reinforce the substrate. Only one of the faces is shown and conventional mechanism for clamping the substrate on the pad assembly secured to this face has not been illustrated for purposes of clarity;

Figure 1:
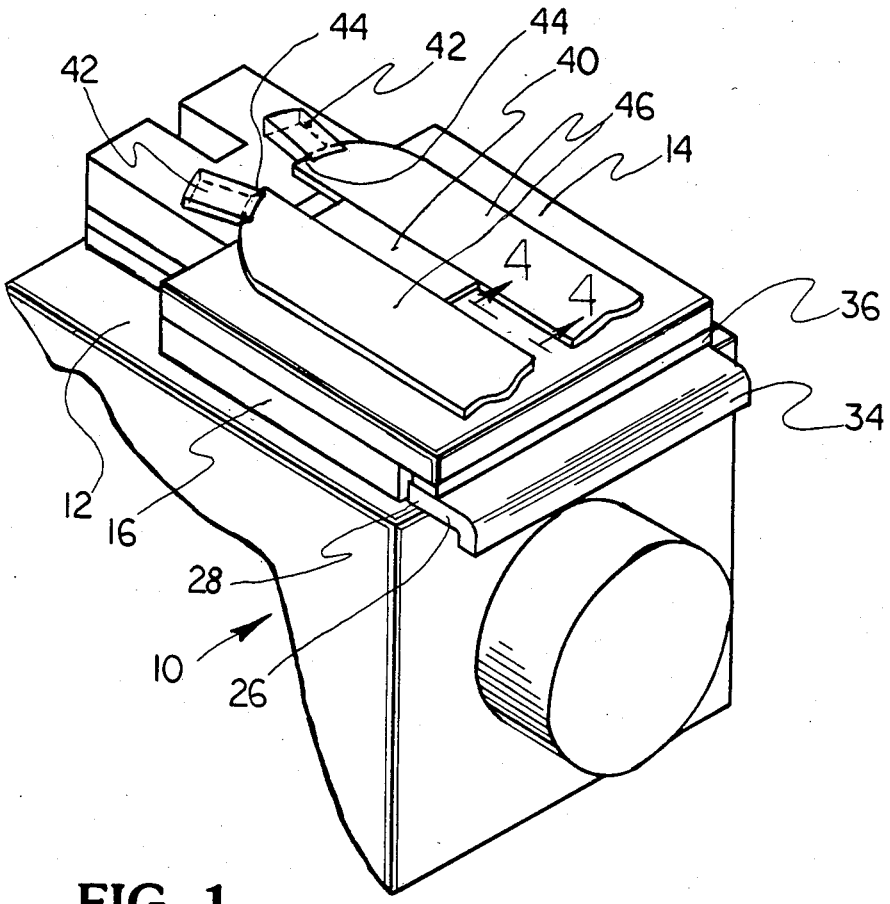

A shoe substrate reinforcing machine which deposits powder in a selected configuration, fuses the powder into a laminate and adheres the fused laminate to a shoe substrate to reinforce the shoe substrate utilizes a work transfer device (a cube 10 having four faces 12). The work transfer cube 10 is mounted on a spindle (not shown) which is indexable to four 90° positions. The top or upper horizontal face 12 is the load/unload face where a shoe substrate to be reinforced can be clamped in position on the support pad 14 of a two part mounting assembly 16 by conventional clamping structure (not shown).

The fixed part of the mounting assembly 16 (FIG. 1) includes a base 18 (FIG. 3), a guide mounting plate 20 which is secured to the base 18 and a pair of guides 22 which are secured to opposite sides of the guide mounting plate 20 to define with the guide mounting plate 20 extended guide ways 24.

Figure 2:
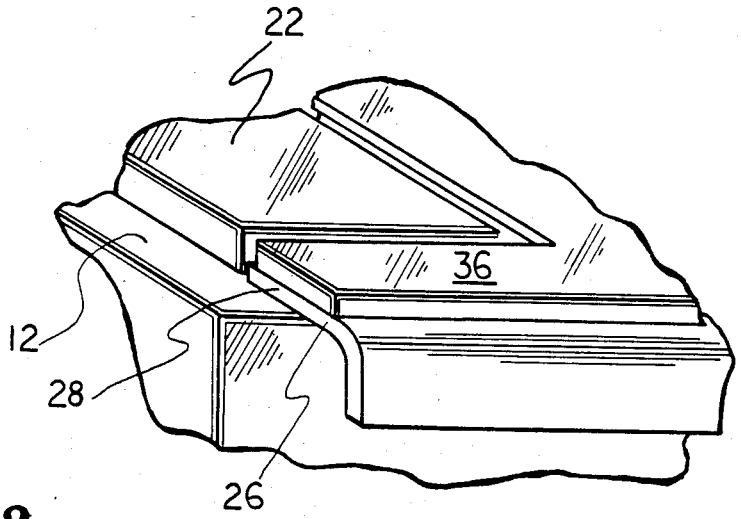
FIG. 2 is a view similar to that of FIG. 1 with the support pad of the pad assembly removed.
Figure 3:
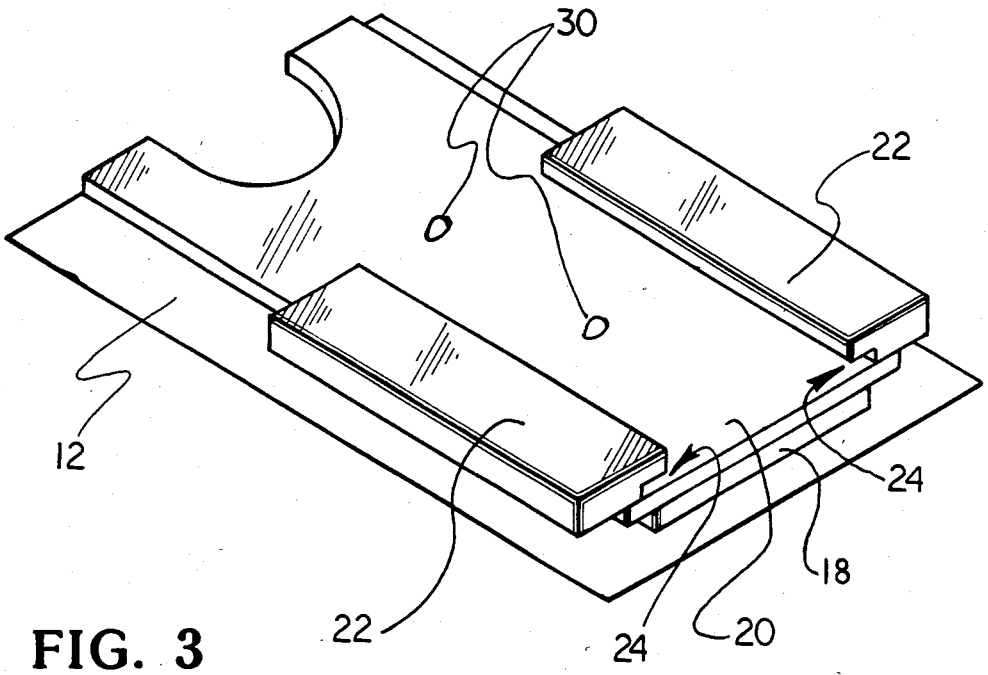
FIG. 3 is a view similar to that of FIG. 1 showing the front left corner of the top face of the transfer cube with the upper resilient layer removed.
Figure 4:
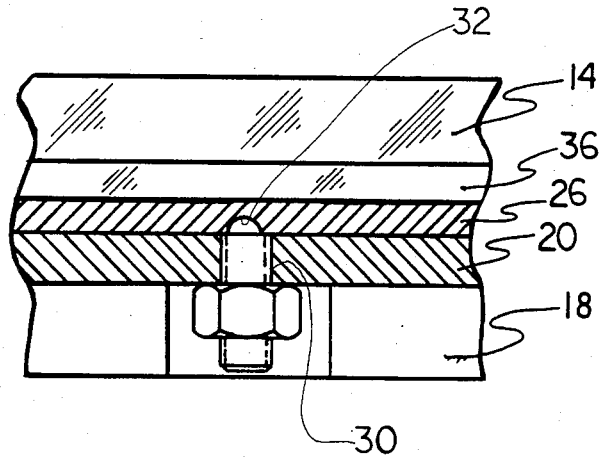
FIG. 4 is a cross-sectional view taken at lines 4—4 of FIG. 1.

The second part of the mounting assembly 16 (FIG. 1) is a pad assembly which has a backing plate 26. The opposite sides of the backing plate 26 are slidably received by the extended guide ways 24 (FIG. 3). A pair of detents in the form of ball plungers 30 secured to the guide mounting plate 20 cooperate with apertures 32 (FIG. 4) defined in the bottom surface of the backing plate 26 to releasably locate the pad assembly at its intended position. The front of the backing plate 26 extends outwardly on each side to define stops 28 (FIG. 2) to prevent overshooting the detents thereby permitting quick insertion of the pad assembly 16. The front portion of the backing plate 26 (FIG. 1) is bent downwardly to form a gripping handle 34 to facilitate insertion and removal.

Secured to the top of the backing plate 26 by adhesive or the like is a "T" shaped layer 36 (FIG. 2) of resilient material. The width of the base portion of this "T" shaped layer 36 corresponds to the separation between the guides 22 and the top portion extends across the backing plate over the stops 28. This layer has the same height as does the guides 22 and accordingly forms with the guides 22 a support surface for the support pad 14. The support pad 14 (FIG. 1) is also made of resilient material having a uniform thickness and is secured by adhesive or the like to the top surface of the lower layer 36 of resilient material and establishes with the lower layer 36 and the backing plate 26 guide slots for receiving the guides 22 (FIG. 3) as the pad assembly is pushed into position on the guide plate 20.

Data in the form of a central registration strip 40 and a pair of symmetrically located registration blocks 42 having inclined front surfaces 44 is secured to the top surface of the support pad 14. The rear portions 46 of a shoe part can be precisely located in side by side relation abutting against the registration strip with the ends of their rear portions in wedged engagement with the registration blocks 42. The transfer cube 10 may then be rotated 180° to a join station and fused laminate supported by a conveyor belt can be pressed into adhering relationship with the located shoe parts 46.

When different parts are to be reinforced, the pad assembly can be removed and replaced by another having different data secured to the top surface of its support pad.

What is claimed is:

1. A machine for depositing powder in a selected configuration, fusing the configured powder into a laminate, and adhering the fused laminate to a shoe substrate to reinforce the substrate, comprising: a transfer structure including (a) a spindle;

(b) a transfer support mounted on said spindle, having a plurality of faces, and movable from position to position by rotation of said spindle;

(c) at least one base attached to said transfer support, the base including an attached guide plate, guide means secured to said guide plate, and detent means secured to said guide plate; and (d) at least one pad assembly slidable into said guide means of said base, each pad assembly including a backing plate having portions to be guided by said guide means, a stopping plate attached to said backing plate for abutting against said guide means when said backing plate is slid to its desired location on said guide plate, backing plate means for cooperating with said detent means to releasably maintain said backing plate at its desired location when said backing plate is located on said guide plate, a pad secured to said stopping plate for supporting a shoe substrate, and a handle attached to said backing plate for sliding said pad assembly into and out of said guide means.

2. A machine for depositing powder in a selected configuration, fusing the configured powder into a laminate, and adhering the fused laminate to a shoe substrate to reinforce the substrate, as recited in claim 1, further comprising: registration data means secured to the top surface of said pad for positioning the shoe substrate on said pad.

* * * * *